US006542117B1

(12) United States Patent
Broughton

(10) Patent No.: US 6,542,117 B1
(45) Date of Patent: Apr. 1, 2003

(54) SATELLITE APPARATUS WITH OMNIDIRECTIONAL AND MANUALLY STEERABLE DIRECTIONAL ANTENNA

(75) Inventor: John William Broughton, Hertfordshire (GB)

(73) Assignee: Inmarsat Limited (GB)

( * ) Notice: Subject to any disclaimer, the term of this patent is extended or adjusted under 35 U.S.C. 154(b) by 0 days.

(21) Appl. No.: 09/423,705

(22) PCT Filed: May 13, 1998

(86) PCT No.: PCT/GB98/01354

§ 371 (c)(1),
(2), (4) Date: Feb. 22, 2000

(87) PCT Pub. No.: WO98/52301

PCT Pub. Date: Nov. 19, 1998

(30) Foreign Application Priority Data

May 14, 1997 (GB) ..... 9709795

(51) Int. Cl.[7] ..... H01Q 3/00; H01Q 21/00

(52) U.S. Cl. ..... 342/359; 343/725

(58) Field of Search ..... 343/725, 758, 343/753, 879, 880, 881, 882, 700 MS; 455/550, 557, 272; 342/359

(56) References Cited

U.S. PATENT DOCUMENTS

| | | | | |
|---|---|---|---|---|
| 4,816,838 A | | 3/1989 | Mizuno et al. | 343/771 |
| 4,907,291 A | | 3/1990 | Yamamoto | 455/78 |
| 5,347,286 A | | 9/1994 | Babitch | 342/359 |
| 5,583,514 A | | 12/1996 | Fulop | 342/359 |
| 5,604,508 A | | 2/1997 | Atkinson | 343/879 |
| 5,628,049 A | | 5/1997 | Suemitsu | 455/11.1 |
| 5,752,204 A | * | 5/1998 | Epperson et al. | 455/575 |
| 5,918,183 A | * | 6/1999 | Janky et al. | 455/550 |

FOREIGN PATENT DOCUMENTS

| | | | |
|---|---|---|---|
| EP | 0 510 997 | | 10/1992 |
| EP | 0 556 941 | | 8/1993 |
| EP | 0 570 325 | | 11/1993 |
| EP | 0 680 156 | | 11/1995 |
| GB | 1 537 389 | | 12/1978 |
| GB | 2 208 189 | | 3/1989 |
| GB | 2 290 868 | | 1/1996 |
| GB | 2 293 494 | * | 3/1996 |
| GB | 2 315 922 | | 2/1998 |
| WO | WO 95/25387 | | 9/1995 |

OTHER PUBLICATIONS

Japanese Pub. No. 73–12517A Abstract, "Radio Transmission Method of Image From Traveling Object", Pub. Date: Nov., 1995.

(List continued on next page.)

*Primary Examiner*—Gregory C. Issing
(74) *Attorney, Agent, or Firm*—Sterne, Kessler, Goldstein & Fox P.L.L.C.

(57) ABSTRACT

A mobile satellite communications terminal (2) comprises a portable computer (68), an interface card (8) containing intermediate frequency (IF) conversion circuitry (28, 52), and an antenna assembly (10) including RF conversion circuitry (34, 50) and an antenna (44). The interface card (8) is connected to the antenna assembly (10) by a detachable cable (32), which carries IF signals. This arrangement reduces RF power losses and interference. The antenna (44) is manually steerable towards a geostationary or quasi-geostationary satellite (12). A navigation signal antenna (56) is mounted on the antenna assembly (10) and is steerable independently of the antenna (44) so as to be vertically aligned, which is the optimum position for receiving navigation signals. The antenna assembly (10) includes orientation sensors (70, 75) which allow the difference between the current and the correct orientation of the antenna (44) to be calculated. This difference is indicated to the user to assist manual steering of the antenna (44).

7 Claims, 8 Drawing Sheets

OTHER PUBLICATIONS

Japanese Pub–No: JP404068704A Abstract, "Portable Electronic Device With Plane Antenna", Pub. Date Mar. 4, 1992.
Japanese Pub. No. JP 60–126929A Abstract, "Radio Communication Equipment", Pub. Date: Jul. 1985.
Japanese Pub. No. 63–06150A Abstract, "Plane Antenna Jointed with Frequency Converter into One Body", Pub. Date: Mar., 1988.

* cited by examiner

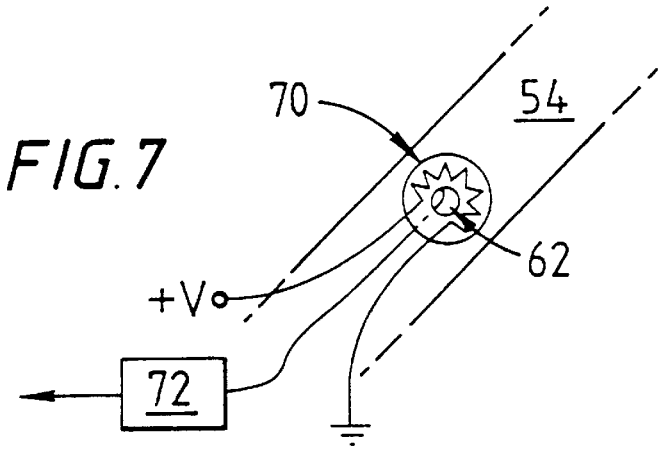
FIG. 7
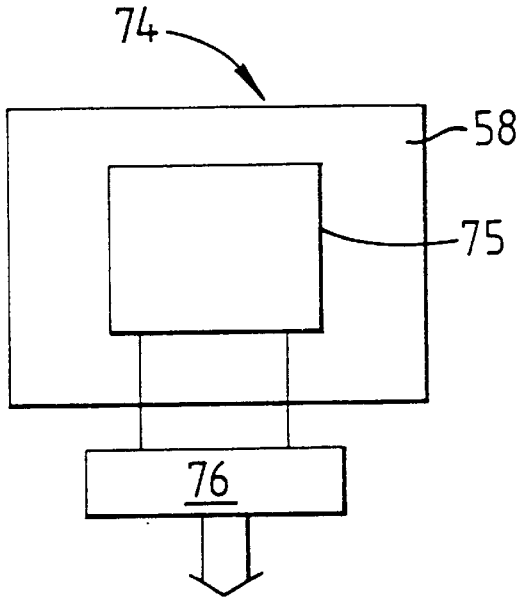
FIG. 8
FIG. 10
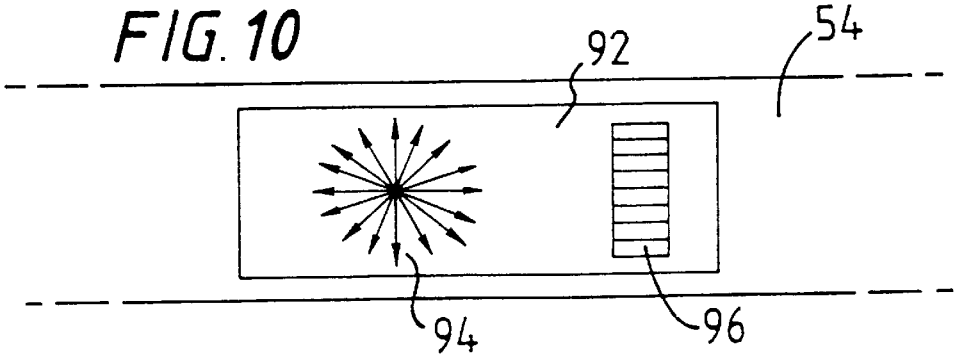

SATELLITE APPARATUS WITH OMNIDIRECTIONAL AND MANUALLY STEERABLE DIRECTIONAL ANTENNA

TECHNICAL FIELD

The present invention relates to a satellite communications apparatus and method, and particularly but not exclusively to apparatus connectable or connected to a communications terminal to enable communication with a geostationary or quasi-geostationary satellite.

The term 'quasi-geostationary' includes satellites which, individually or collectively, do not move significantly in elevation or bearing relative to a user during a communications session and which do not require accurate knowledge by the user of their position as a function of time. Thus, the satellites may be geosynchronous with a small orbital inclination relative to the equator, so that the deviation in latitude of the satellites is not significant to the user. Alternatively, the satellites may be in highly elliptical orbits such as the LOOPUS orbit in which the satellites dwell over an area of the earth's surface for several hours around their apogee. With such orbits, individual satellites may move significantly relative to the user provided that calls are handed off to another satellite so that there is always a satellite available to the user within a range of positions which can be covered by the user antenna without adjustment during a communications session.

BACKGROUND ART

In satellite communications systems which use geostationary satellites, user terminals commonly communicate with the satellites by means of directional antennas, in order to provide a satisfactory gain in the communications link to and from the satellite. The directional antenna must be steered towards the geostationary satellite.

One example of such a system is the Inmarsat-B™ system, designed primarily for use with ship-based terminals. The antenna assemblies for these terminals are large, typically comprising a 0.9 m diameter parabolic antenna with stabilization and automatic satellite tracking mechanisms.

Another example of such a system is the Inmarsat-M™ system, which shares many of the design features of Inmarsat-B™, but is able to support more compact user terminals, including portable terminals the size of a briefcase.

The advent of geostationary satellites, such as the Inmarsat-3™ satellites, with multiple spot beams per satellite and higher power and sensitivity has further reduced the minimum gain requirements of user terminals for use with such satellites. It is therefore possible to provide high-bandwidth communication services to a user terminal the size of a laptop computer. However, the mechanism required for satellite tracking cannot be miniaturized to the same extent. Therefore, antennas for portable satellite terminals are steered manually towards the satellite.

The document EP 0 570 325 describes a portable satellite communications terminal in which the antenna is flat and housed in the lid of a briefcase, together with a radio-frequency (RF) transmitter/receiver, which is connected to a laptop computer. The briefcase lid can be retained at different inclinations so as to point the antenna towards the satellite; azimuthal orientation is achieved by rotating the briefcase. Manual pointing is assisted by inputting the user's longitude and latitude into the computer, which then displays the correct azimuth and elevation angle for the antenna. However, even if the user knows the azimuth and elevation of the satellite, it is not a simple matter to point the antenna in that direction.

The document U.S. Pat. No. 5,347,286 discloses an alternative approach, in which the pointing of an antenna at a satellite is automated by means of a GPS receiver and two GPS antennas mounted on the communications antenna. This approach requires at least two servo motors and associated gear assemblies to steer the antenna in elevation and azimuth. The whole antenna assembly is intended to fit into a suitcase, while the communications terminal itself must be carried in another case. Hence, the equipment required is inconvenient for personal mobile communications.

STATEMENT OF INVENTION

According to one aspect of the present invention, there is provided a portable satellite communications antenna with an additional antenna mounted thereon for receiving navigation signals, such as GPS or GLONASS signals. The inclination of the communications antenna can be manually adjusted to point at a geostationary or quasi-geostationary satellite while the navigation antenna is adjusted to point directly upwards.

With the above arrangement, satellite communications and navigation equipment can be conveniently integrated, while allowing both the navigation and communications antennas to be pointed in the optimum direction.

Preferably, the navigation antenna can be stowed within or against the communications antenna assembly for ease of carrying or storage.

According to another aspect of the present invention, there is provided apparatus for satellite communication in which the radio frequency transmitter/receiver is divided into two discrete parts: an intermediate frequency part which converts baseband signals into intermediate frequency signals and vice versa, and an RF conversion part which converts the intermediate frequency signals into RF signals and vice versa. The intermediate frequency part may be integrated with interface circuitry for connection to a general purpose computer, while the RF conversion part may be integrated with a satellite antenna assembly. The intermediate frequency signals are carried between the parts by suitable connection means such as a cable, suitable cable connectors being provided at each of the parts.

The above separation of intermediate and radio frequency parts is advantageous for the following reasons. The placement of the radio frequency part close to the antenna reduces the loss involved in passing RF signals down a cable and the need to use expensive coaxial cable for this connection. The power amplification requirements of the RF stage are also reduced. Furthermore, the separation of the RF stage from the interface stage reduces interference in the RF stage from the internal circuitry of the computer. In addition, the intermediate frequency stage can be miniaturized sufficiently to be contained within a small interface card, such as a PCMCIA card, for use with portable computers.

Moreover, the same intermediate frequency stage may be connected to different RF stages and antennas, which may be required if the same communications terminal is to be used with different systems or in different countries where different frequency bands are used for satellite communications.

According to another aspect of the present invention, there is provided satellite communications apparatus which senses the orientation of a satellite communications antenna, compares this orientation with the correct orientation for satellite communications, and indicates to the user how the orientation should be adjusted to achieve the correct orientation. This arrangement greatly facilitates the setup of a satellite communications antenna, since the user does not have to deal with any absolute measures of direction, but merely adjusts the antenna as indicated until it is pointed correctly. The indication may be performed by a display of a computer connected to the communications apparatus, or by a separate indicator located close to the antenna so that the user need not look at the computer display while adjusting the antenna.

DESCRIPTION OF THE DRAWINGS

Specific embodiments of the present invention will now be described with reference to the accompanying drawings, in which:

FIG. 7 shows an arrangement for determining electronically the inclination of the antenna;

FIG. 8 shows an arrangement for determining electronically the azimuthal orientation of the antenna;

FIG. 10 shows a display located on the antenna housing for assisting the user in pointing the antenna.

MODES FOR CARRYING OUT THE INVENTION

System Overview

Figure 1:
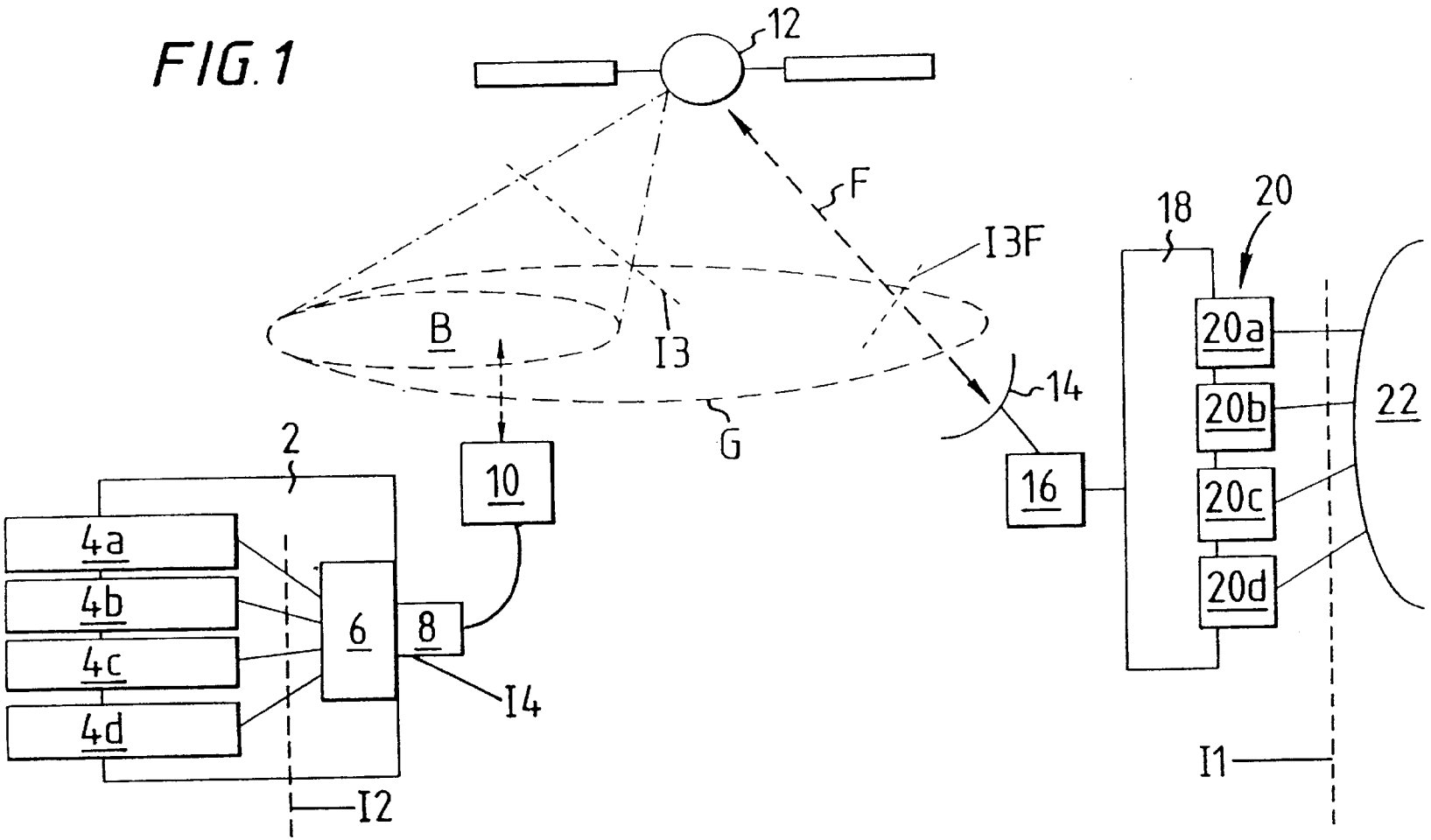
FIG. 1 PRIOR ART
FIG. 1 shows a diagram of a satellite communications system allowing communication with mobile terminals.

FIG. 1 shows a satellite communication system as described in UK patent application no. GB9625475.0, the contents of which are incorporated herein by reference.

FIG. 1 shows schematically a mobile terminal connected via a satellite 12 to a network management centre 18, which allocates bandwidth to the mobile terminal and connects the mobile terminal to a terrestrial network 22. In this embodiment, the mobile terminal 2 comprises a portable computer on which a number of different communications applications 4*a*, 4*b*, 4*c*, 4*d* may be run. For example, the applications may be a voice telephony application, an internet-based application, a facsimile application and an ATM network-based application. Each of these applications use standard application programming interfaces (API) such as Winsock for internet access, TAPI for telephony applications and CAPI for ISDN applications. The interfaces to such applications are shown schematically by the reference I2 in FIG. 1. Driver software 6 converts API protocols to proprietary protocols designed for the satellite communication system. The mobile terminal 2 provides a physical interface I4 to an interface card 8, such as a PC (formerly PCMCIA) card. The driver software 6 may be executed by a processor on the interface card 8 and/or by a processor of the mobile terminal.

The interface card 8 is connected to an antenna assembly 10 via a radio frequency modulator/demodulator. The radio modulator/demodulator is able to receive on a first frequency channel and to transmit simultaneously on a second frequency channel.

The antenna assembly 10 is located within the coverage region of a spot beam B generated by the satellite 12, which may for example be a geostationary satellite having multibeam receive/transmit antennas for receiving and transmitting signals in each of a plurality of spot beams B. Each spot beam B carries a plurality of frequency channels both in the forward and return directions. The satellite also receives and transmits in a global beam G which has a coverage area extending substantially or completely over the coverage areas of the spot beams B. The global beam B carries at least one forward and one return frequency channel.

The RF signals transmitted between the antenna assembly 10 and satellite 12 comply with an air interface protocol I3, which is more fully described in GB 9625475.0. The satellite 12 acts as a repeater and converts channels from multiple spot beams B into channels in a feeder beam F and vice versa. The feeder beam F provides a link between the satellite 12 and an earth station 16 via an earth station antenna 14. The air interface protocol over the feeder beam F is referenced as I3F in FIG. 1.

The network management centre 18 is connected to the earth station 16 and includes a number of different service adaptors 20*a*, 20*b*, 20*c*, 20*d* providing an interface to terrestrial networks 22, such as PSTN, ATM networks or ISDN. For example, the service adaptors 20 may comprise a telephony adaptor 20*a* including a codec for converting voice signals on a PSTN to data at the network management centre 18 and vice versa. A facsimile service adaptor 20*b* may implement facsimile protocols, such as defined in ITU Recommendations T.30 and T.4 and include a modem for communication over a PSTN. An internet service adaptor 20*c* implements TCP/IP and an ATM service adaptor 20*d* implements ATM protocols. These standard protocols and interfaces are designated collectively by I1 in FIG. 1.

The mobile terminal 2 allows multiple different types of communication to be set up over the satellite communication system, such as telephony, internet, fax and ATM. These applications may be run concurrently. The bandwidth allocated to each application may be varied independently in the forward and return directions during a call as described in GB 9625475.0.

Antenna and Interface Components

Figure 2:
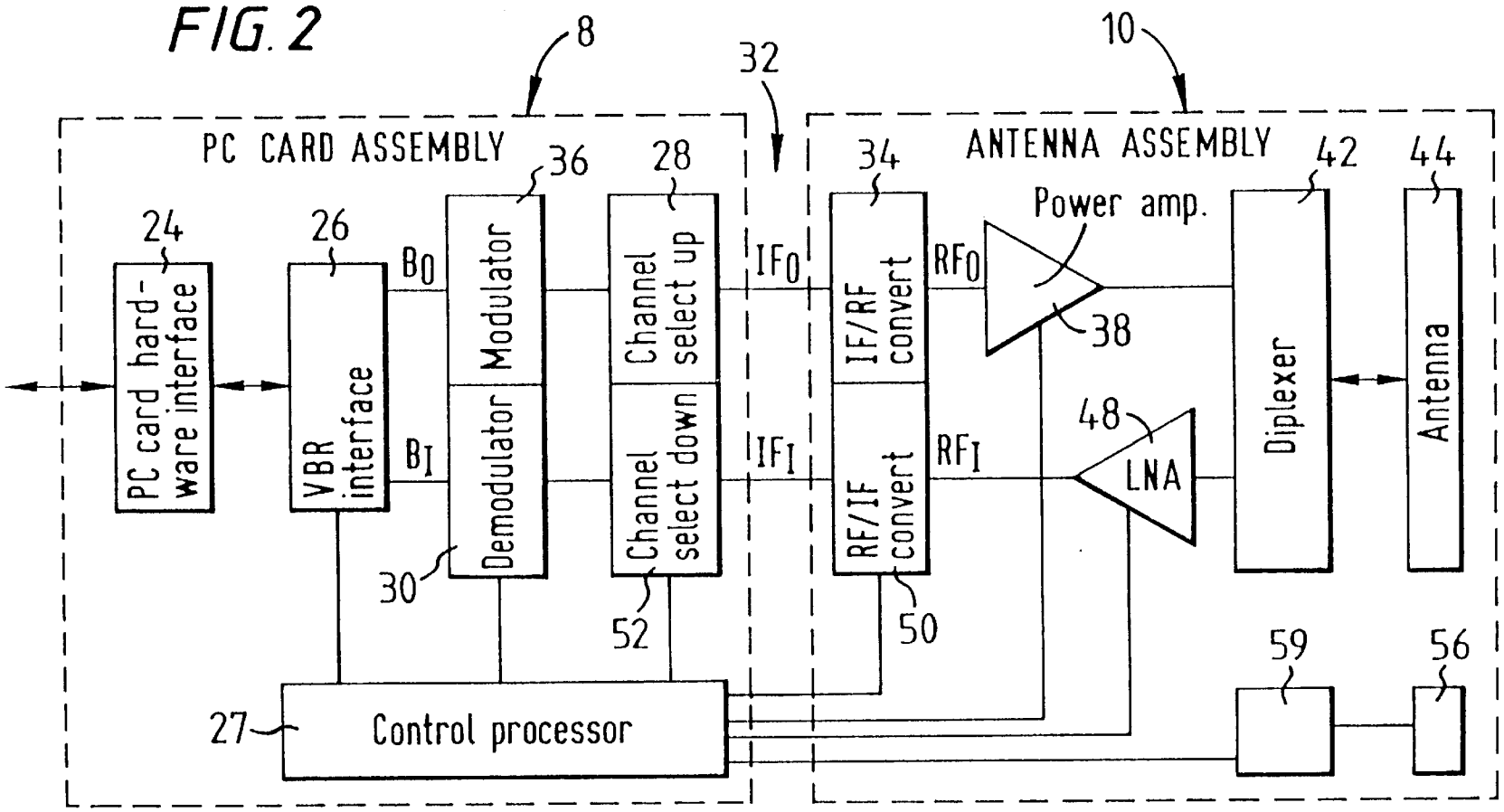
FIG. 2 is a diagram of the components of a mobile terminal for use with the system shown in FIG. 1.

FIG. 2 shows in greater detail the components of the interface card 8 and of the antenna assembly 10. The interface card 8 includes I/O circuitry 24, complying with the PC Card Standard, through which baseband communication signals are exchanged between the portable computer and a variable bit rate (VBR) interface 26. The VBR interface 26 may be implemented by a DSP which buffers received data and data to be transmitted, and implements communications protocols compatible with the driver software 6. The operation of the interface card 8, including the VBR interface 26, is controlled by a control processor 27.

Baseband signals $B_O$ are output by the VBR interface 26 to a modulator 36 and then to an intermediate frequency (IF)

up converter 28, which performs channel selection. The baseband signals $B_O$ are thereby upconverted to IF signals $IF_O$ in a frequency range in the region of 65 MHz.

The IF signals $IF_O$ are output through a cable connector (not shown) onto a cable 32, which is removably connected to the cable connector. The other end of the cable 32 is removably connected to a cable connector of the antenna assembly 10. In the antenna assembly 10, the intermediate frequency signals $IF_O$ are upconverted to radio frequency by an RF upconverter 34 to generate RF signals $RF_O$ in a frequency range in the region of 3 GHz. The RF upconverter 34 may comprise a single stage mixer with low pass filter.

The RF signals $RF_O$ are then amplified by a power amplifier 38 and output through a diplexer 42 to an antenna 44. The antenna 44 comprises a four-element microstrip patch fixed array mounted as described below.

RF signals $RF_I$ received by the antenna 44 are passed through the diplexer and are amplified by a low-noise amplifier 48, providing 15 to 20 dB gain and with a 1 dB noise figure. The amplified received RF signals $RF_I$ are then down-converted by an RF down-converter 50, including a post-amplifier, to generate received IF signals $IF_I$ in the region of 65 MHz; these are output onto the cable 32.

In the interface card 8, the received IF signals $IF_I$ are down-converted by a down-converter 52 which performs channel selection, and demodulated by a demodulator 30, to generate received baseband signals $B_I$ which are input to the baseband processor 26.

The interface card 8 and antenna assembly 10 are powered by the battery of the laptop computer. The power connections are not shown, for clarity. Alternatively, the antenna assembly 10 may be powered by a separate battery contained therein.

Optionally, the antenna assembly includes an omnidirectional antenna 56, which is able to receive signals from the GPS/NAVSTAR and/or GLONASS satellites, and a navigation signal receiver 59 for demodulating and decoding the navigation signals to generate navigation information, for example in the NEMA standard format. The navigation information is outputted through the cable 32, and is processed by the control processor 27 to select the required information, which is output over the I/O circuitry 24 to the portable computer. Alternatively, the navigation information may be output directly to the portable computer over the I/O circuitry 24, so that the navigation information may be used for other applications.

Antenna and Interface Construction

The physical appearance and the arrangement of the antenna assembly 10 is shown in FIGS. 3*a* to 3*d*. The antenna assembly 10 comprises a housing 54 formed as a single piece of moulded plastic of dimensions 21 cm by 30 cm×2.5 cm. On the front face of the housing 54 are mounted an array of four microstrip patch antennas 44*a* to 44*d*, forming the antenna 44. The beamwidth of the antenna is approximately 30° by 40°.

Figure 3A:
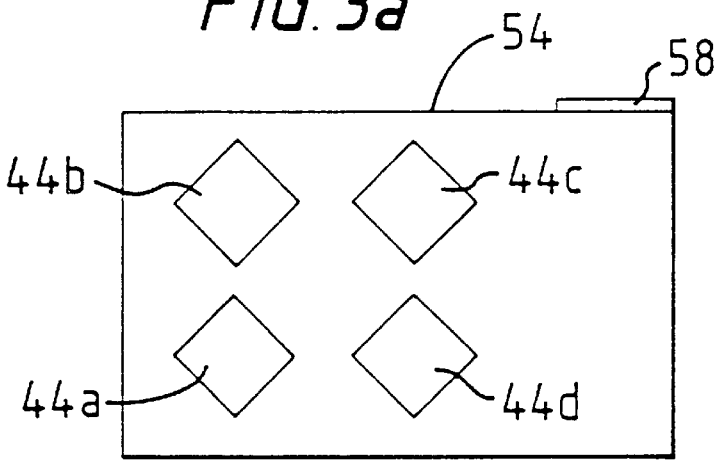
FIGS. 3*a* to 3*d* show respectively a front view, side view, rear view and side view in operating position of an antenna assembly of the user terminal.
Figure 3B:
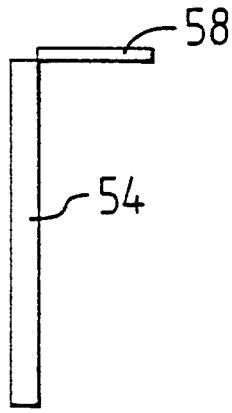

The patch antennas may be flush with the front face of the housing 54, as shown in FIG. 3*a*, or recessed below the surface of the housing and covered by the front face of the housing so that they are protected by the housing and are not visible to the user; the front face thereby appears as a uniform flat plastic surface which is resistant to damage and dirt.

A GPS patch antenna 56 is mounted on a support 58, which is attached by a hinge to the top surface of the housing 54. The GPS patch antenna 56 has a beam pattern which is omnidirectional about an axis A perpendicular to the patch and to the major surface of the support 58, so as to be able to receive signals from any of the NAVSTAR satellites which have a sufficient elevation angle above the horizon when the axis A of the GPS antenna 56 is approximately vertical. However, the beam pattern is not isotropic, but falls off below the minimum elevation angle when the axis A is vertical, giving for example an approximate beamwidth of 160°. Instead of a patch antenna, a helix antenna may be used, mounted in a rod-shaped housing.

In use, the antenna assembly 10 is angled so that the boresight B of the antenna 44 is inclined at the correct angle i for pointing at the satellite 12. The antenna assembly 10 is supported in its inclined position by a U-shaped support arm 60 made of metal tube or other suitably rigid material. The support arm is connected to either side of the housing 54 by pivoting joints 62 to allow the support arm 60 to rotate about a horizontal axis relative to the housing 54. The friction of the pivoting joints is set or is adjustable so that the antenna assembly stays securely at the inclined position in which it is put, but the inclination angle can be adjusted easily. In use, the boresight B is inclined within a range between the minimum workable elevation angle of the satellite 12, such as 10°, and the zenith in which case the housing 54 is laid flat on its back surface.

Figure 3C:
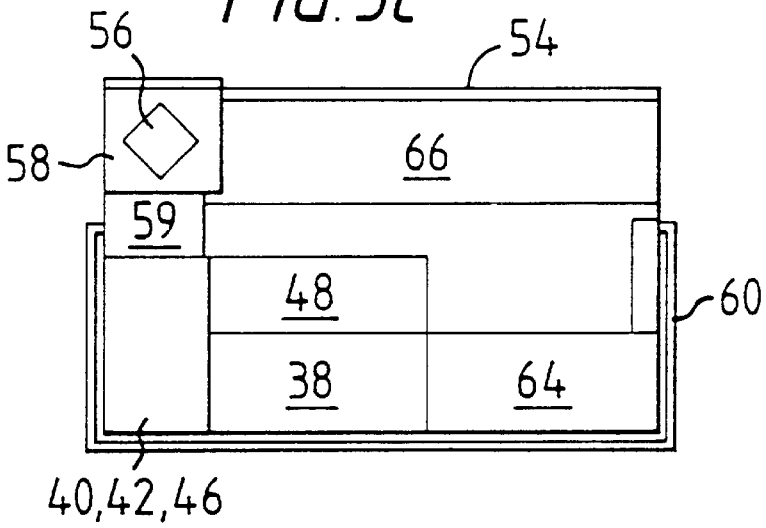
Figure 3D:
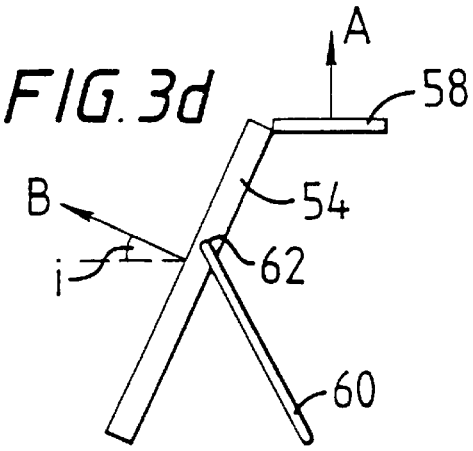

The remaining components of the antenna assembly 10 are mounted on the rear surface of the housing 54. The relative positions of the diplexer 40, the power amplifier 38, the low-noise amplifier 48 and the GPS receiver 59 are shown in FIG. 3*c*. The position of control and regulation circuitry 64 for the power amplifier 38 is also shown. On the upper rear surface of the housing 54 is located a storage recess 66 in which the interface card 8 can be stored when not in use, together with the cable 32.

When not in use, the GPS antenna support 58 can be folded back to lie flat against the rear surface of the housing 54, as shown in FIG. 3*c*. The entire antenna assembly 10 and interface card 8 can therefore be stored compactly in a small space, such as a compartment in a carrying case which also holds a laptop computer, thus allowing a complete satellite communications terminal to be carried in a package of the same size or smaller than a carrying case for a laptop computer.

Figure 4A:
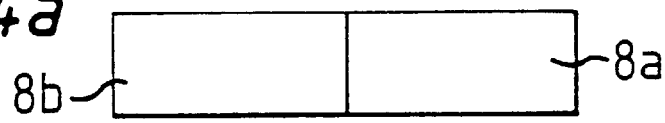
FIGS. 4*a* to 4*d* show respectively a plan view, side view and plan view with cable attached of an interface card for the user terminal, and a front view of the interface card inserted into a portable computer.
Figure 4B:
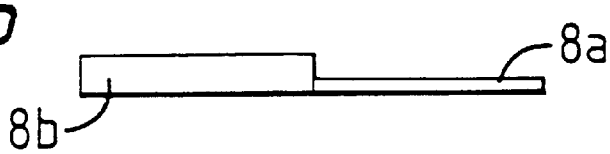
Figure 4C:
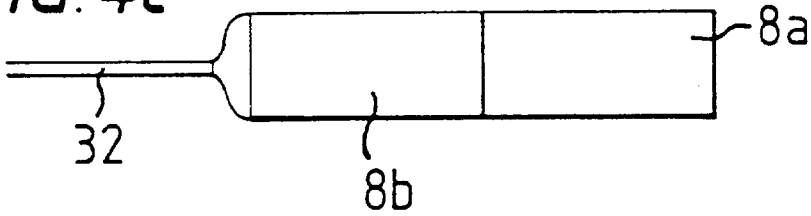
Figure 4D:
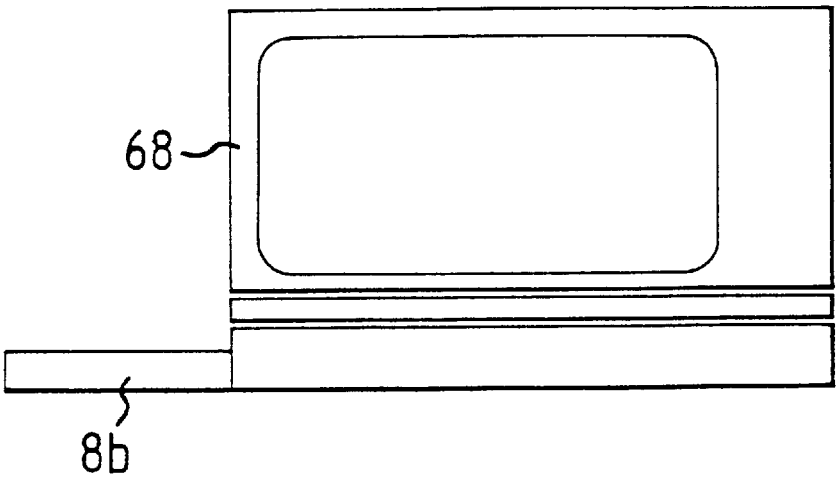

The external appearance of the interface card 8 is shown in FIGS. 4*a* to 4*d*. The interface card 8 has a first portion 8*a* which has the width and thickness of a Type II PC Card and carries the I/O connector at its distal end, and a second portion 8*b* which is thicker than the first portion and carries the cable connector at its distal end. The second portion 8*b* contains those components of the interface card which cannot be fitted within the first portion 8*a*. As shown in FIG. 4*d*, the first portion 8*a* fits within a PC card slot of a laptop computer 68, while the second portion 8*b* protrudes from the slot. As the miniaturization and power consumption of the components required for the interface card 8 improves, they may be contained within the first portion 8*a* so that the interface card 8 can be manufactured as a standard length PC card with the cable connector at its outer end.

As an alternative, where a desktop computer is used instead of the laptop computer 68, the interface card 8 may be a card, such as an ISA or PCI card, installed in the desktop computer.

Antenna Orientation Calculation Methods

The satellite antenna 44 is manually steered by positioning the antenna assembly 10 in the correct azimuthal direction and adjusting its inclination so that the boresight B is pointed to the satellite 12 to within a predetermined degree dependent on the beamwidth of the antenna 44. When more than one satellite 12 is present above a minimum elevation angle, one of these satellites 12 is selected. Methods for assisting the user in performing these functions will now be described.

Figure 5:
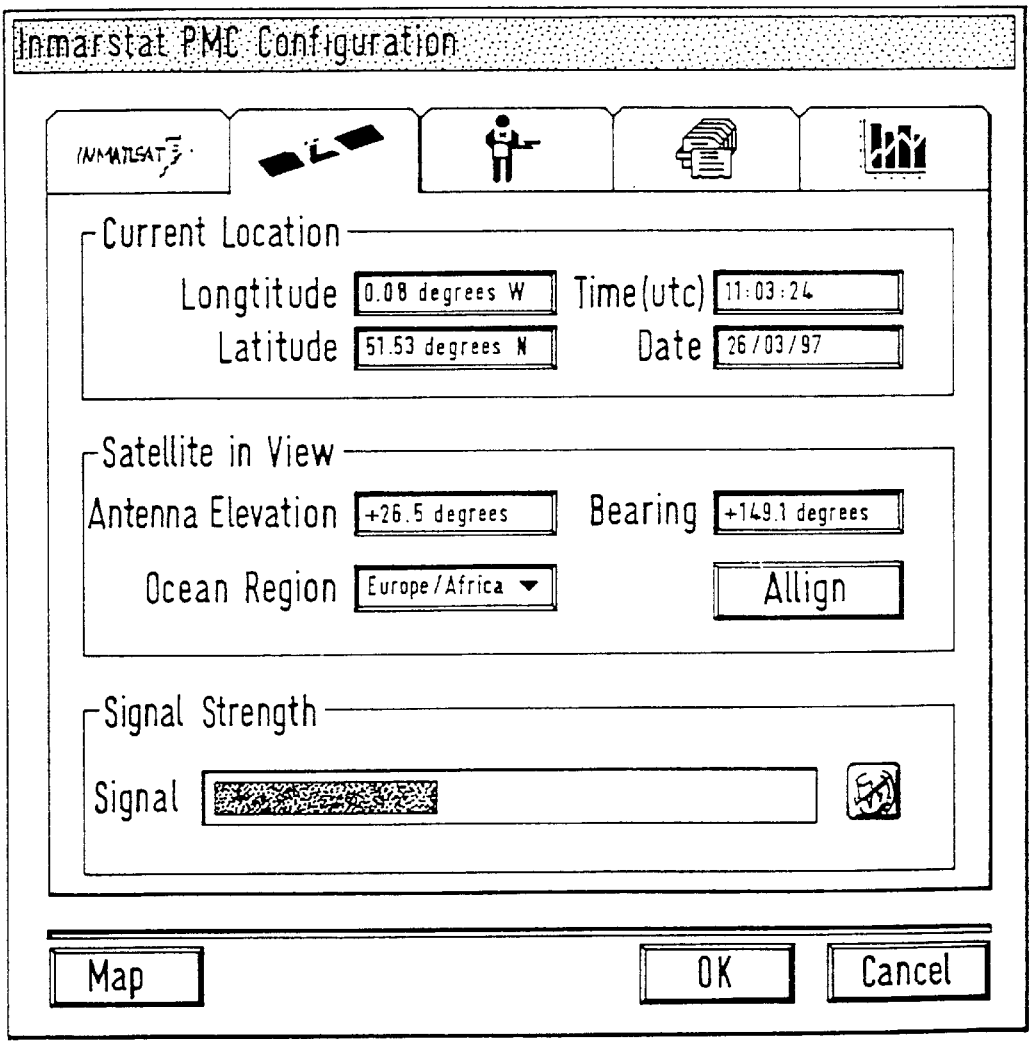
FIG. 5 shows a display of the portable computer for assisting manual setup of the antenna.

In one embodiment, the output from the GPS receiver 59 is input through the interface card 8 to the laptop computer 68 so that the current location of the terminal 2 can be calculated. This calculation is performed by the GPS receiver 59 and longitude and latitude information is output to the laptop computer 68 through the interface card 8. Software running on the laptop computer 68 determines which satellite 12 has the highest elevation angle from the position determined by the GPS receiver, calculates the elevation and bearing to that satellite, and displays this information to the user. An example of such a display, using the Windows-95™ user interface, is shown in FIG. 5. The entry 'Ocean Region' identifies which satellite has been selected.

The display also indicates the current strength of the signal, which may be used by the user to confirm that the antenna 44 is pointed correctly. Alternatively or additionally, the laptop computer 68 may generate tones representing the signal strength.

Figure 6:
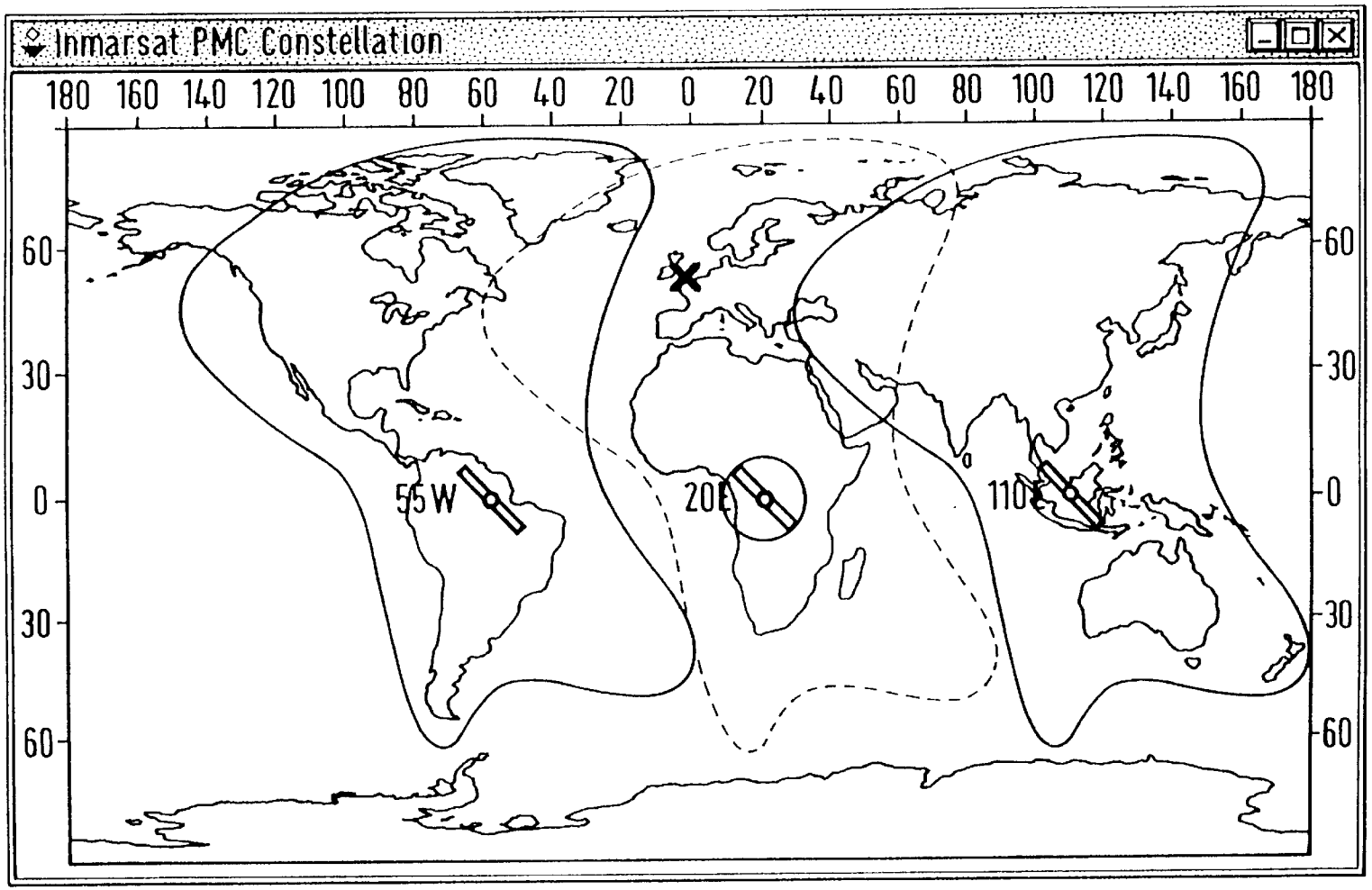
FIG. 6 shows a display of the portable computer allowing a user to enter the location of the terminal.

In another embodiment, which does not require GPS information, the laptop computer 68 displays a world map with the positions of the satellites 12 and their coverage patterns superimposed, as shown in FIG. 6. A cross-shaped pointer is moved by the user by means of a pointing device until it lies over the user's location and the user then "clicks" the pointing device to enter that position. The correct bearing and elevation to the satellite 12 is displayed to the user, for example as shown in FIG. 5.

Pointing Assistance

Enhancements of the antenna assembly 10 which help the user to point the antenna 44 correctly will now be described.

In one embodiment, a scale is provided adjacent one of the pivoting joints 62 to indicate visually the boresight elevation angle of the antenna 44. Alternatively, as shown in FIG. 7, a rotary position sensor 70 comprising a rotatable potentiometer 70 is mounted in one of the pivoting joints 62, with the slider connected to the support arm 60 and the resistance wire connected to the housing 54, or vice versa. The voltage of the slider is amplified by an amplifier 72 and converted to a digital value by an A/D converter 72 mounted within the housing 54. The output of the A/D converter 72 is fed through a line of the cable 32 to the interface card 8 and thence to the laptop computer 68.

A compass 74 may be mounted on the antenna assembly 10, to show the azimuthal orientation thereof. Alternatively, an electronic compass comprising an array of Hall effect magnetometers 75 is mounted in a suitable position, such as on the GPS antenna support 58, as shown in FIG. 8. A controller 76 reads the voltages of the magnetometers 75 and outputs data representing the orientation thereof which is output through the cable 32 and the interface card 8 to the laptop computer 68.

Figure 9:
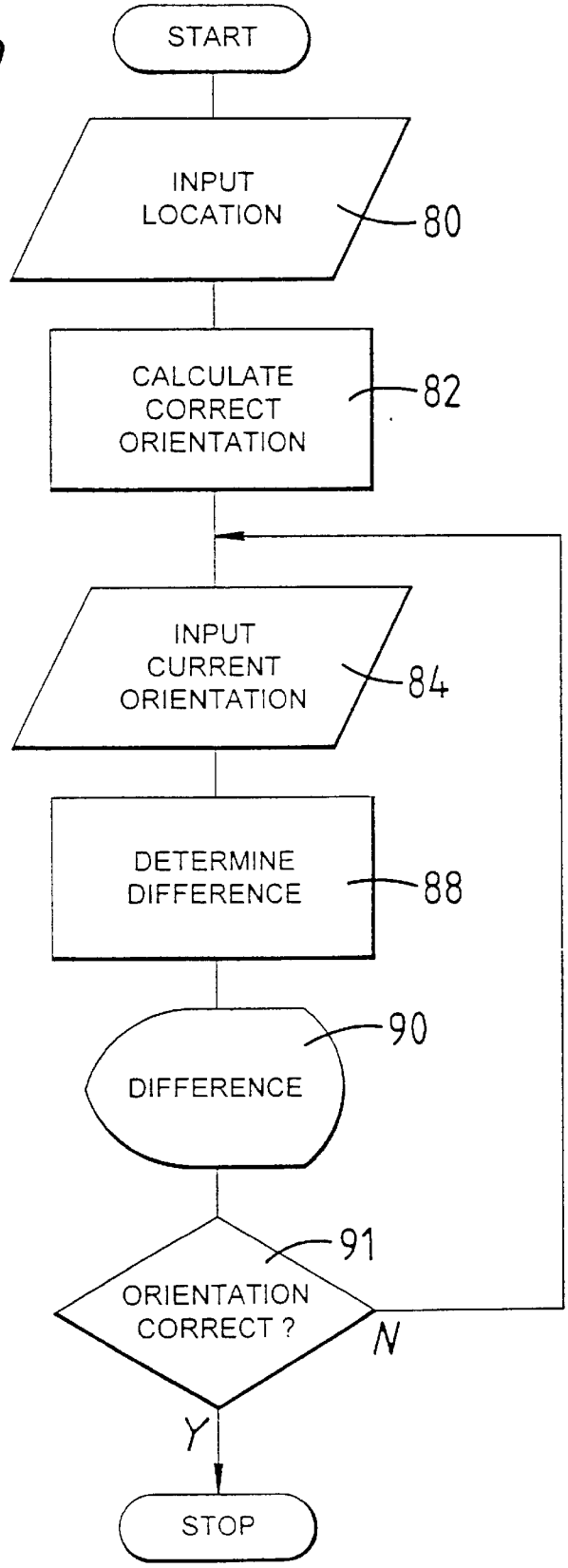
FIG. 9 is a flowchart of a method of assisting the user in pointing the antenna.

Software running on the laptop computer 68 performs a method as shown in FIG. 9 to assist the user in pointing the antenna 44. At the beginning of the set-up procedure, GPS data is input from the GPS receiver (Step 80) and the correct bearing and inclination of the preferred satellite 12 is calculated (Step 82). Orientation data is input from the controller 76 and the A/D converter 72 to determine the actual current orientation of the antenna 44 (Step 84). A difference between the actual and correct orientations is then calculated (Step 88). This difference is then indicated to the user (Step 90). The process of steps 84 to 90 is repeated so that the user can adjust the antenna by rotating the whole antenna assembly 10 in azimuth and adjusting the inclination of the housing 54 by pivoting the support arm 60 until the difference displayed to the user at step 90 is sufficiently small.

The indication at step 90 may take one or more of the following forms. The difference may be displayed on the screen of the laptop computer 68 in graphical form, such as an arrow pointing up or down if the inclination should be increased or decreased respectively, with the size of the arrow being proportional to the adjustment required. Likewise, the required change in azimuth is displayed by arrows pointing left or right.

The difference may be displayed by LED's, LCD's or other display devices mounted on the housing 54 and controlled by an output of the laptop computer 68 through the interface card 8. For example, FIG. 10 shows an LCD display on the top surface of the housing 54 having arrow display elements 94, one of which is activated at any one time to indicate the bearing to the satellite 12, and inclination display elements 96 which indicate to what degree the inclination should be altered up or down.

The difference may be indicated to the user by means of sound generated by the laptop computer, such as tones or synthesized spoken instructions.

The current signal strength may also be displayed on a display mounted on the housing, to confirm that the antenna 44 is correctly pointed.

Alternative apparatus for electronic detection of orientation may be used instead of the examples described above. For example, the potentiometer 70 has the disadvantage that it does not measure the true inclination of the antenna, but only the inclination relative to the plane on which the antenna assembly stands. An electronic clinometer may be used instead, to give an absolute reading of inclination.

The GPS antenna support 58 may be freely pivotally mounted and weighted so that it adopts a position with the axis of the GPS antenna aligned vertically under the influence of gravity. This removes the need for the user to steer the GPS antenna, at the expense of some additional weight. When not in use, the GPS antenna support is retained against the housing 54.

The GPS antenna support 58 may be stowed against or within the housing 54 in one of many different ways. For example, the housing 54 may include a cut-out or recess into which the support 58 fits when not in use.

Instead of the single antenna 44 and the diplexer, the antenna assembly 10 may have separate antennas for transmission and reception, which removes the need for a diplexer but requires additional surface area for the antennas.

The apparatus described above may be modified to receive navigation signals other than GPS signals, such as GLONASS signals and/or differential correction signals transmitted by terrestrial stations or satellites. Additional navigation signals may be received from the satellite 12 by the antenna 44.

While the user terminal 2 is described above as being based on a conventional laptop computer, it is evident that the rapid technological progress in the display, processor, storage, battery and other fields will lead to smaller and/or more powerful portable computers becoming available, with alternative input devices such as voice recognition and touch-sensitive input becoming more common. It is also evident that new operating systems and interface standards will emerge. The above embodiments may be modified to take advantage of these and other developments without departing from the scope of the present invention.

What is claimed is:

1. Satellite antenna apparatus connectable or connected to a satellite communications terminal, comprising:

a manually steerable directional antenna for communication with a geostationary or quasi-geostationary satellite, the directional antenna being manually steerable in inclination; and an omnidirectional antenna having an axis about which a reception property of the omnidirectional antenna is omnidirectional;

wherein the omnidirectional antenna is mounted on the directional antenna such that the inclination of the omnidirectional antenna axis is adjustable in use relative to the inclination of the directional antenna to align the omnidirectional antenna axis substantially with the vertical.

2. Apparatus as claimed in claim 1, wherein the omnidirectional antenna is connected to the directional antenna via a hinged coupling.

3. Apparatus as claimed in claim 1, wherein the directional antenna is mounted in a housing and the omnidirectional antenna is stowable against or within the housing when not in use.

4. Apparatus as claimed in claim 1, wherein the omnidirectional antenna is a navigation antenna for receiving navigation signals.

5. Apparatus as claimed in claim 1, further comprising a support structure for supporting the directional antenna at an inclination to which it is manually steered within a range of inclinations.

6. Apparatus as claimed in claim 5, wherein said range of inclinations is from 10° to 90°.

7. Apparatus as claimed in claim 2, wherein the directional antenna is mounted in a housing and the omnidirectional antenna is stowable against or within the housing when not in use.

* * * * *